US006769952B1

(12) United States Patent
Drosendahl et al.

(10) Patent No.: US 6,769,952 B1
(45) Date of Patent: Aug. 3, 2004

(54) MOBILE AND METHOD OF USING THE SAME

(75) Inventors: Christine Ann Drosendahl, East Aurora, NY (US); Albert Maggoire, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/386,104

(22) Filed: Mar. 12, 2003

(51) Int. Cl.[7] ..... A63H 33/00
(52) U.S. Cl. ..... 446/227
(58) Field of Search ..... 446/227

(56) References Cited

U.S. PATENT DOCUMENTS

| | | | | |
|---|---|---|---|---|
| 1,084,375 | A | | 1/1914 | Swinehart |
| 1,574,226 | A | | 2/1926 | Ackermann |
| 1,634,162 | A | | 6/1927 | Tesk |
| 1,651,836 | A | | 12/1927 | Rangel |
| 1,786,459 | A | | 12/1930 | Simons |
| 1,806,773 | A | | 5/1931 | Waters |
| 2,158,902 | A | | 5/1939 | Gray |
| 2,452,749 | A | | 11/1948 | Guden |
| 2,490,230 | A | | 12/1949 | Riegel |
| 2,686,030 | A | | 8/1954 | Johnson |
| 2,858,641 | A | | 11/1958 | Trimble |
| 3,014,307 | A | | 12/1961 | Dupuis |
| 3,078,593 | A | | 2/1963 | Miller |
| 3,114,216 | A | | 12/1963 | Crawford et al. |
| 3,180,600 | A | | 4/1965 | Kopec |
| D213,982 | S | | 4/1969 | Simon |
| 3,628,005 | A | | 12/1971 | Rhoades |
| 3,719,002 | A | | 3/1973 | Jernstrom |
| 3,900,978 | A | | 8/1975 | Sloan |
| 3,919,795 | A | | 11/1975 | Van Horne Jinivisian et al. |
| 3,927,482 | A | * | 12/1975 | Marcus ..... 40/455 |
| 3,983,647 | A | | 10/1976 | Stubbmann |
| 4,207,696 | A | | 6/1980 | Hyman et al. |
| 4,214,808 | A | * | 7/1980 | Hampson ..... 359/616 |
| 4,250,537 | A | * | 2/1981 | Roegner et al. ..... 362/86 |
| 4,285,028 | A | | 8/1981 | Sundin et al. |
| 4,363,181 | A | | 12/1982 | Hyman et al. |
| 4,573,654 | A | | 3/1986 | Nottingham |
| 4,640,034 | A | | 2/1987 | Zisholtz |
| 4,670,820 | A | | 6/1987 | Eddins et al. |
| 4,756,109 | A | | 7/1988 | Marcus |
| 4,858,079 | A | | 8/1989 | Ohashi |
| 5,029,047 | A | | 7/1991 | Kachel |
| 5,044,961 | A | | 9/1991 | Bruskewitz |
| 5,192,041 | A | | 3/1993 | Bryant |
| 5,324,224 | A | | 6/1994 | Anderson et al. |
| D349,735 | S | | 8/1994 | Cacciola et al. |
| 5,370,570 | A | | 12/1994 | Harris |
| 5,387,146 | A | | 2/1995 | Smith et al. |
| 5,555,658 | A | | 9/1996 | Yu |
| 5,664,746 | A | | 9/1997 | Benzakarya |
| 5,672,088 | A | | 9/1997 | Chininis |
| 5,803,786 | A | | 9/1998 | McCormick |
| 5,931,716 | A | | 8/1999 | Hopkins et al. |
| 5,951,360 | A | | 9/1999 | Fearon et al. |
| 6,113,455 | A | | 9/2000 | Whelan et al. |

FOREIGN PATENT DOCUMENTS

| | | | | |
|---|---|---|---|---|
| DE | 37 18 369 | A1 | | 12/1988 | |
| FR | 2 660 573 | A1 | | 10/1991 | |
| FR | 2681528 | A1 | * | 3/1993 | ..... A61H/5/00 |
| GB | 188254 | | | 11/1922 | |
| GB | 306202 | | | 2/1929 | |
| WO | WO 90/08582 | | | 8/1990 | |

* cited by examiner

*Primary Examiner*—Derris H. Banks
*Assistant Examiner*—Ali Abdelwahed
(74) *Attorney, Agent, or Firm*—Cooley Godward LLP

(57) ABSTRACT

A mobile includes a housing and a reflective member rolatably coupled to the housing. A drive mechanism is desposed in the housing and is configured to rotate the reflective member with respect to the housing. The mobile also includes an illuminating member coupled to the housing and disposed to illuminate the reflective member.

31 Claims, 5 Drawing Sheets

MOBILE AND METHOD OF USING THE SAME

BACKGROUND OF THE INVENTION

This invention relates to a mobile, and, in particular, to a mobile that provides superior visual stimuli, and a method of using the mobile.

Entertainment devices for infants such as mobiles are known. Existing mobiles are typically attached to an infant's crib and can be operated to entertain or soothe an infant with moving toy characters or pleasing sounds. While providing some benefits, existing mobiles sometimes do not provide adequate stimulus to entertain or soothe an infant for a desired period of time. Often the stimulus provided by the mobiles is not sufficient for infants whose visual acuity is not fully developed. For example, newborns are unable to clearly perceive objects that are disposed more than an arm's length away from their eyes.

A need exists for a mobile with superior features to entertain or soothe infants. In particular, a need exists for a mobile that can entertain or soothe infants with reflected light.

SUMMARY OF THE INVENTION

An embodiment of a mobile includes a housing and a reflective member rotatably coupled to the housing. A drive mechanism is disposed in the housing and is configured to rotate the reflective member with respect to the housing. An illuminating member is coupled to the housing and is disposed to illuminate the reflective member.

These and other aspects of the present invention will become apparent from the following drawings and description.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE INVENTION

Figure 1:
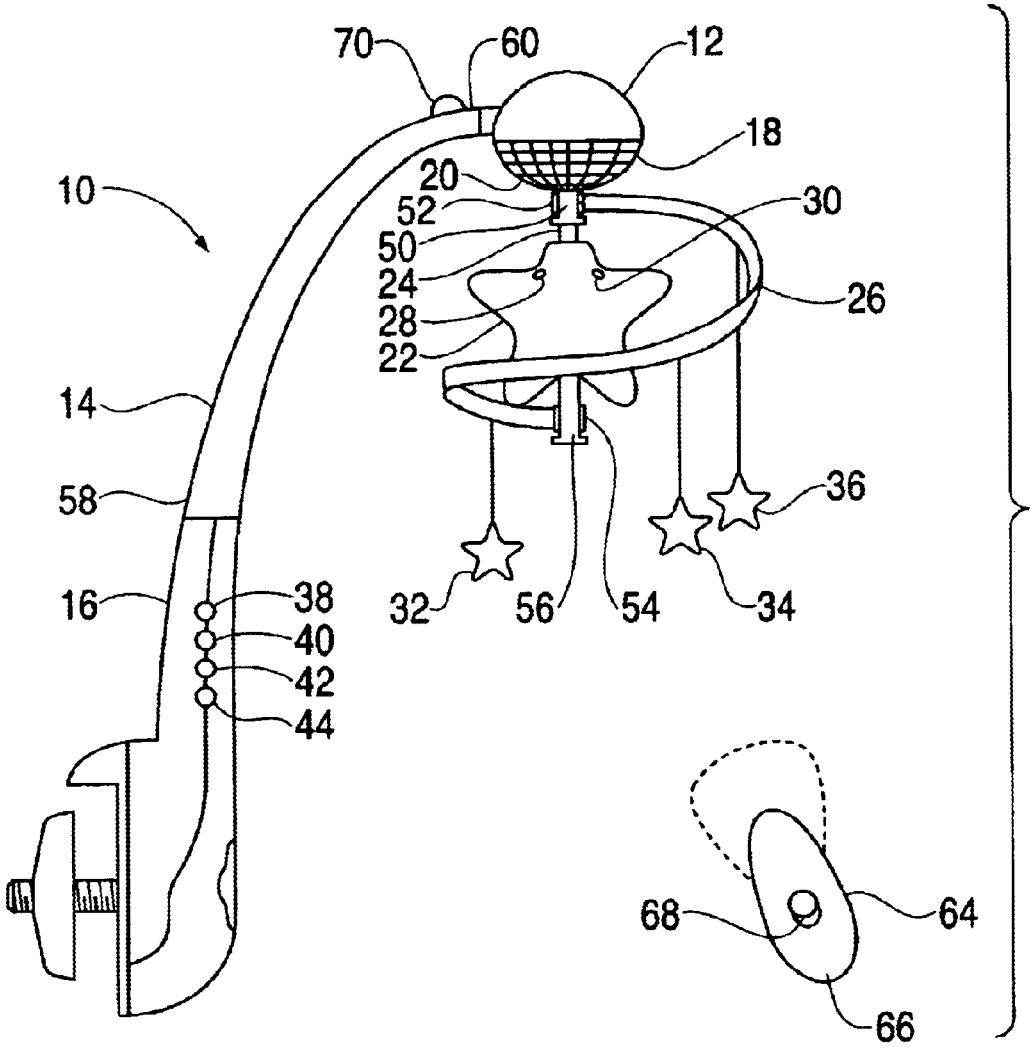
FIG. 1 illustrates a side view of an embodiment of a mobile in accordance with the present invention.
Figure 2:
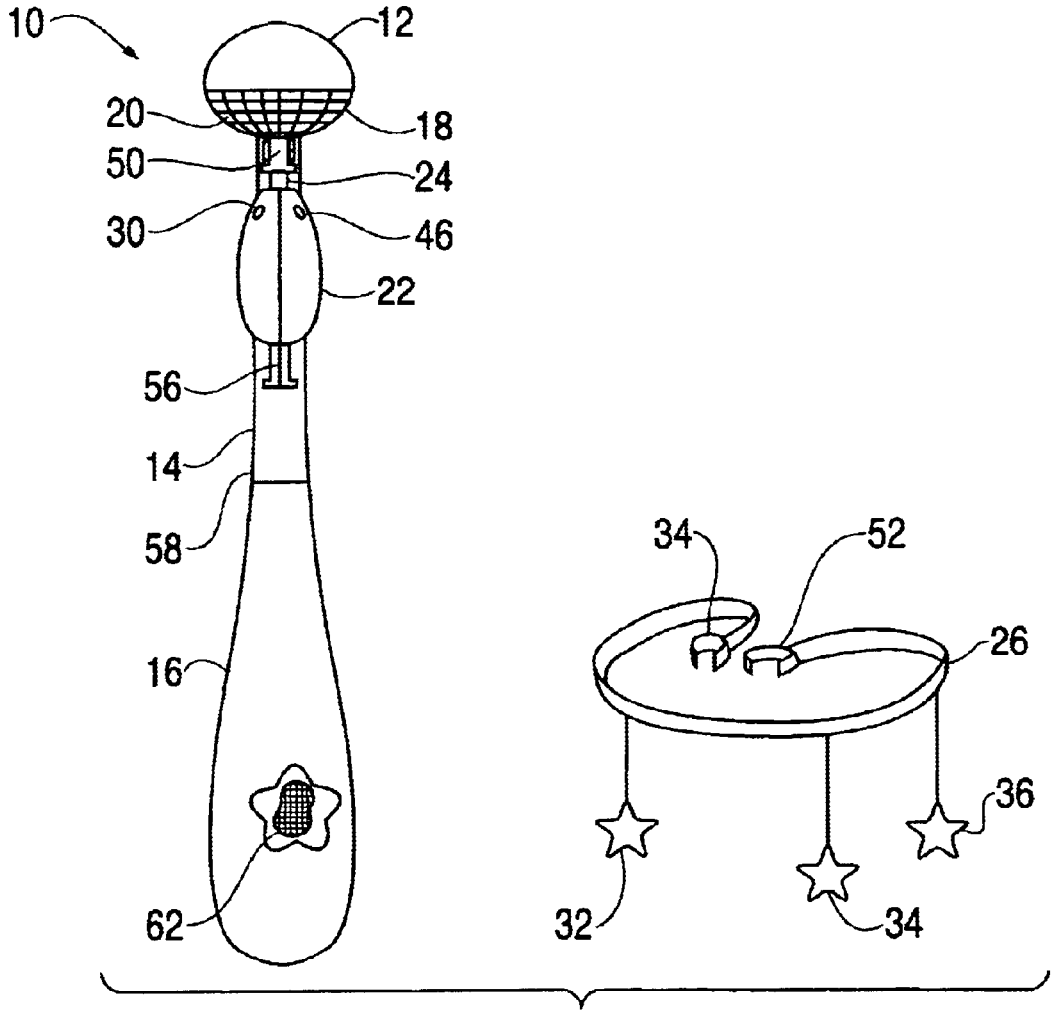
FIG. 2 illustrates a front view of the mobile of FIG. 1 in a partially disassembled configuration.

An embodiment of a mobile 10 in accordance with the present invention is illustrated in FIGS. 1 and 2. The mobile 10 includes a housing 12 and a reflective member 18 that is rotatably coupled to the housing 12. In the illustrated embodiment, the mobile 10 includes a drive mechanism 104 (see FIG. 3) disposed in the housing 12. The drive mechanism 104 is coupled to the reflective member 18 and is configured to rotate the reflective member 18 with respect to the housing 12. The operation of the drive mechanism 104 is discussed in greater detail below with respect to FIG. 3.

As illustrated in FIGS. 1 and 2, the reflective member 18 is substantially hemispherical and is mounted below the housing 12 with its convex side facing downwardly. The reflective member 18 has a reflective outer surface 20 that is formed of a reflective material, such as a mirror-like material. In the illustrated embodiment, the reflective outer surface 20 is formed of several planar reflective surfaces that are interconnected in a manner similar to a conventional disco ball. As illustrated in FIGS. 1 and 2, the reflective member 18 includes an extension 50 that extends downwardly from the reflective member 18.

The mobile 10 also includes an illuminating member 22 that is disposed below the reflective member 18. The illuminating member 22 is coupled to the housing 12 via a coupling. element 24, which extends through the reflective member 18. In the illustrated embodiment, the illuminating member 22 is fixedly coupled to the housing 12 via the coupling element 24, such that the orientation of the illuminating member 22 is substantially maintained when the reflective member 18 is rotated.

The illuminating member 22 includes walls that form an interior region or cavity therebetween. In the illustrated embodiment, the walls of the illuminating member 22 are formed of a translucent material, such as a translucent plastic. As illustrated in FIGS. 1 and 2, the illuminating member 22 can include an extension 56 that extends downwardly therefrom.

In the illustrated embodiment, the illuminating member 22 is configured to illuminate the reflective member 18. The illuminating member 22 includes several light sources, including light sources 28, 30, 46, and 154 (see also FIG. 4). The light sources 28, 30, 46, and 154 are disposed on an upper surface of the illuminating member 22 (opposite reflective member 18) and are oriented to direct light upwardly towards the reflective member 18. Light directed upwardly by the light sources 28, 30, 46, and 154 is reflected downwardly by the reflective outer surface 20 of the reflective member 18. As the reflective member 18 is rotated, the angles at which the upwardly directed light strikes the planar reflective surfaces of the reflective outer surface 20 change. Such changing angles in turn create a changing reflected light pattern below the mobile 10, such as a changing pattern of light sparkles. The light sources 28, 30, 46, and 154 may be illuminated simultaneously or intermittently.

In the illustrated embodiment, the illuminating member 22 also includes light sources 156, 158, and 160 (see FIG. 4), which are disposed in the interior region of the illuminating member 22. The light sources 156, 158, and 160 are oriented to direct light through the translucent walls of the illuminating member 22. The operation of the light sources 156, 158, and 160 is discussed in greater detail below with respect to FIG. 4.

Referring to FIGS. 1 and 2, the mobile 10 can include a suspension member 26. The suspension member 26 is elongated and has a first end 52 and a second end 54. The first end 52 and the second end 54 are configured to releasably couple the suspension member 26 to the reflective member 18 and the illuminating member 22, respectively. In the illustrated, embodiment, the first end 52 can be formed as a clamp to allow releasable coupling to the extension 50 of the reflective member 18. In a similar fashion, the second end 54 is formed as a clamp to allow releasable coupling to the extension 56 of the illuminating member 22. In the illustrated embodiment, the first end 52 is configured to accommodate the extension 50 while providing sufficient coupling to the extension 50 to allow cooperative movement of reflective member 18 and the suspension member 26. The second end 54 is configured to accommodate the extension 56 and to allow movement of the suspension member 26. With the suspension member 26 in its attached configuration as illustrated in FIG. 1, the suspension member 26 rotates with the reflective member 18 as the reflective member 18 is rotated. Rotation of the suspension member 26 creates the appearance of a spiral that revolves about the illuminating member 22. Alternatively, the suspension member 26 may be detached as illustrated in FIG. 2.

As illustrated in FIGS. 1 and 2, the mobile 10 can include several toy characters 32, 34, and 36 that are coupled to the suspension member 26. In the illustrated embodiment, the toy characters 32, 34, and 36 resemble stars. In an alternative embodiment, the toy characters 32, 34, and 36 may take other shapes, such as cubes, spheres, animals, and so forth. With the suspension member 26 in its attached configuration as illustrated in FIG. 1, the toy characters 32, 34, and 36 rotate with the suspension member 26 as the reflective member 18 is rotated. Rotation of the toy characters 32,34, and 36 creates the appearance of stars that revolve about the illuminating. member 22.

As illustrated in FIGS. 1 and 2, the mobile 10 includes a base 16. The base 16 is configured to couple the mobile 10 to a support structure, such as an infant crib. The base 16 includes several apertures or recesses in which an audio selection button 38, an illumination selection button 40, an activation button 42, and a volume adjustment switch 44 are located. The operation of the audio selection button 38, the illumination selection button 40, the activation button 42, and the volume adjustment switch 44 is discussed in greater detail below. As illustrated in FIG. 2, the base 16 includes several openings 62 through which audio outputs from a sound generating mechanism 206 (see FIG. 5) can be heard. The operation of the sound generating mechanism 206 is discussed in greater detail below with respect to FIG. 5.

As illustrated in FIGS. 1 and 2, the mobile 10 includes a support member 14. The support member 14 is elongated and extends upwardly from the base 16. The support member 14 has a lower end 58 and an opposite, upper end 60. The lower end 58 is coupled to the base 16, and the upper end 60 is coupled to the housing 12.

Referring to FIG. 1, the mobile 10 includes a remote actuator 64. The remote actuator 64 may be implemented as an infrared remote actuator, such as described in U.S. Pat. No. 6,116,983, entitled "Remotely Controlled Crib Toy" and issued on Sept. 12, 2000, the disclosure of which is incorporated herein by reference in its entirety. As illustrated in FIG. 1, the remote actuator 64 includes a remote actuator housing 66. The remote actuator housing 66 includes an aperture in which an activation button 68 is located. User engagement of the activation button 68 results in an infrared signal being generated by an infrared transmitter (not shown). In the illustrated embodiment, an infrared receiver 70 disposed on the support member 14 receives the infrared signal. The operation of the activation button 68 is discussed further below.

Figure 3:
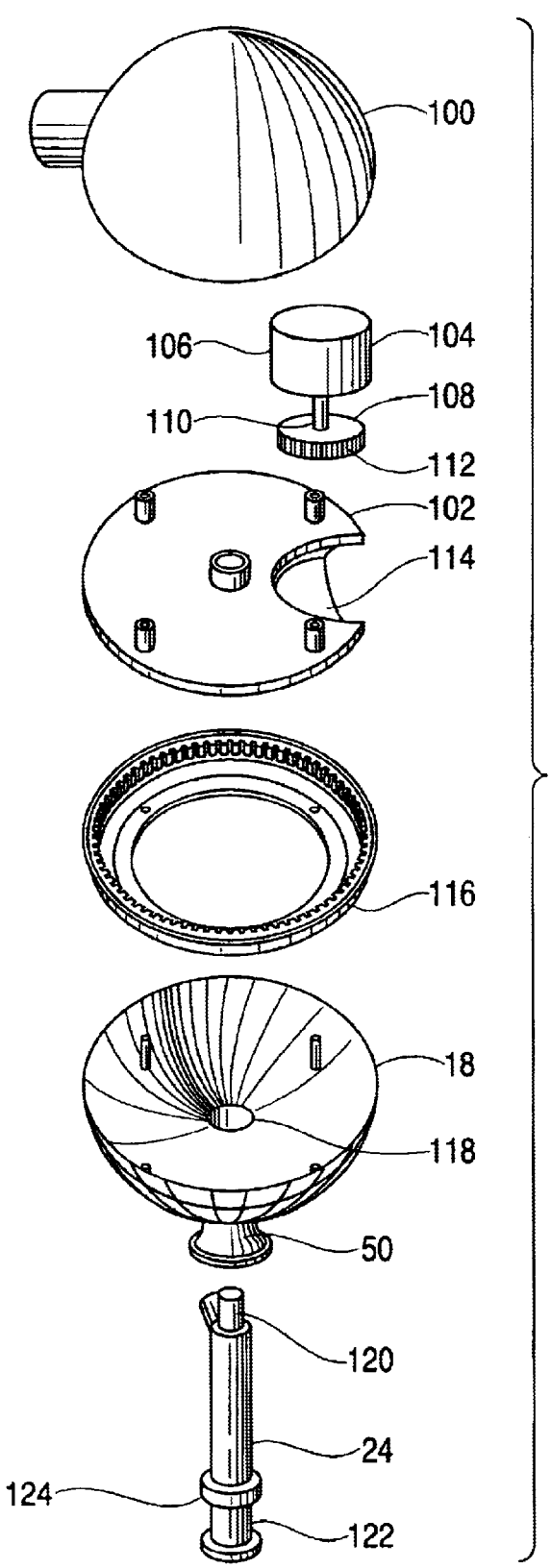
FIG. 3 illustrates an exploded perspective view of the housing and drive components of the mobile of FIG. 1.
Figure 4:
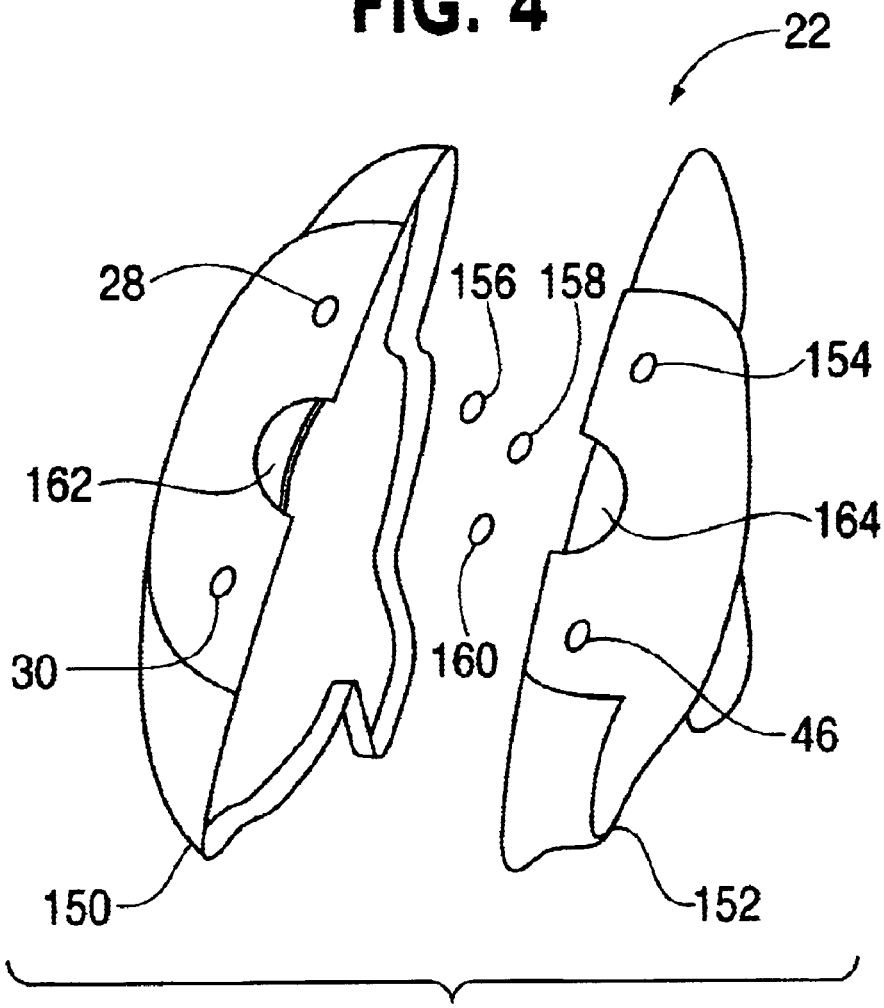
FIG. 4 illustrates an exploded perspective view of an illuminating member of the mobile of FIG. 1.
Figure 5:
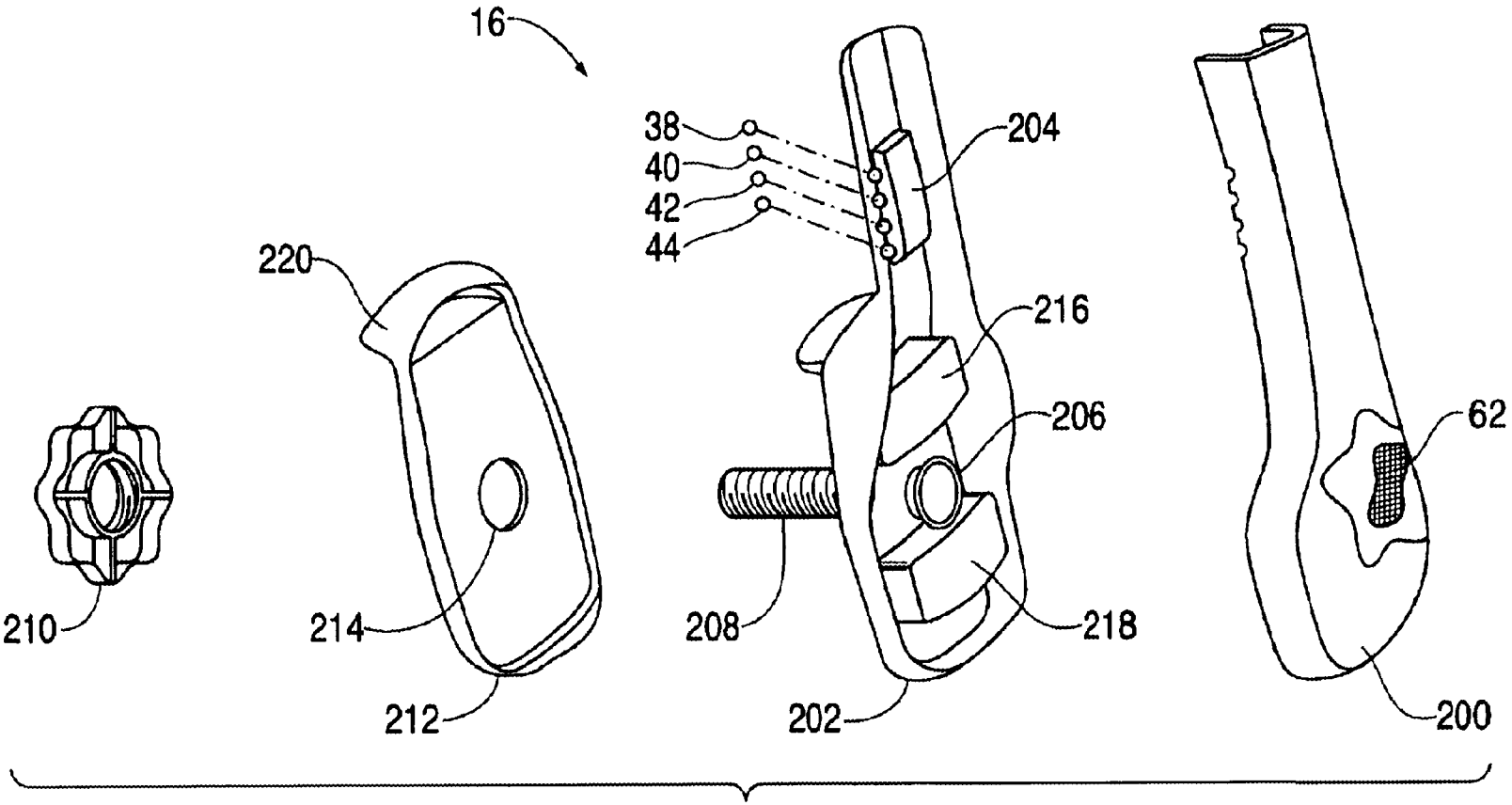
FIG. 5 illustrates an exploded perspective view of a base of the mobile of FIG. 1.

An embodiment of several components of the mobile 10 is illustrated in FIGS. 3 through 5. Referring first to FIG. 3, an exploded perspective view of an upper portion of the mobile 10 is illustrated.

In the illustrated embodiment, an upper housing portion 100 is configured to be coupled to a lower housing portion 102 to form the housing 12 (see FIGS. 1 and 2). A drive mechanism 104 is disposed within an interior region or cavity formed by the upper housing portion 100 and the lower housing portion 102. As illustrated in FIG. 3, the drive mechanism 104 includes a drive unit 106 and a drive element 108 that is coupled to the drive unit 106. The drive unit 106 includes a motor (not shown), which can be any conventional motor. The drive unit 106 may also include a drive train (not shown), which can include several gears and/or pulleys. The drive unit 106 is configured to rotate the drive element 108. As illustrated in FIG. 1, the drive element 108 includes a shaft 110 and a gear 112 that is coupled to the shaft 110.

The drive element 108 is operatively coupled to the reflective member 18 to rotate the reflective member 18. In the illustrated embodiment, the drive element 108 is coupled to the reflective member 18 via a planetary gear 116. As illustrated in FIG. 3, the lower housing portion 102 is formed with a recess 114 to accommodate the drive element 108. The planetary gear 116 is disposed below the lower housing portion 102 and meshes with the gear 112 within the recess 114. In the illustrated embodiment, the planetary gear 116 is fixedly coupled to the reflective member 18.

As illustrated in FIG. 3, the reflective member 118 defines an opening 118. The opening 118 extends through the extension 50 of the reflective member 18. In the illustrated embodiment, the opening 118 is sized to accommodate the coupling element 24 and to allow rotation of the reflective member 18 about the coupling element 24. The coupling element 24 includes a first end 120, a ring-like extension or collar 124, and a second end 122. The coupling element 24 extends through the opening 118, such that the first end 120 is coupled to the lower housing portion 102. In the illustrated embodiment, the first end 120 is fixedly coupled to the lower housing portion 102, such that the orientation of the coupling element 24 is substantially maintained when the reflective member 18 is rotated. The ring-like extension 124 of the coupling element 24 is configured to engage the extension 50 of the reflective member 18 to support the reflective member 18. The second end 122 of the coupling element 24 is coupled to the illuminating member 22 (see FIGS. 1, 2, and 4).

Turning next to FIG. 4, an exploded perspective view of the illuminating member 22 is illustrated. In the illustrated embodiment, the illuminating member 22 includes a translucent front wall 150 and a translucent rear wall 152. The translucent front wall 150 is configured to be coupled to the translucent rear wall 152 to form an interior region or cavity therebetween. As illustrated in FIG. 4, the translucent front wall 150 and the translucent rear wall 152 are formed with recesses 162 and 164. The recesses 162 and 164 are sized to accommodate the second end 122 of the coupling element 24 (see FIG. 3) to couple the illuminating member 22 to the coupling element 24.

As illustrated in FIG. 4, the illuminating member 22 includes several light sources, including light sources 28, 30,46, 154, 156, 158, and 160. Each light source can be any conventional light source, such as a light bulb or a light emitting diode. In the illustrated embodiment, the light sources 28, 30, 46, and 154 are disposed on upper surfaces of the translucent front wall 150 and the translucent rear wall 152 and are oriented to direct light upwardly towards the reflective member 18 as discussed previously.

In the illustrated embodiment, the light sources 156, 158, and 160 are disposed in the interior region of the illuminating member 22. The light sources 156, 158, and 160 are oriented to direct light through the translucent front wall 150 and the translucent rear wall 152 of the illuminating member 22. In the illustrated embodiment, the light sources 156, 158, and 160 are configured to generate differently colored light, such as green, orange, and yellow light. During operation, the light sources 156, 158, and 160 can be illuminated intermittently or in a pattern to create a changing visual appearance, such as resembling a glowing star. Colored light generated by the light sources 156, 158, and 160 can overlap to provide additional colors.

FIG. 5 illustrates an exploded perspective view of the base 16 of the mobile 10. In the illustrated embodiment, the base 16 includes a front portion 200 and a rear portion 202. The front portion 200 is configured to be coupled to the rear portion 202 to form an interior cavity therebetween.

As illustrated in FIG. 5, a control unit 204 and a sound generating mechanism 206 are disposed in the interior cavity. The control unit 204 is configured to receive various user inputs and to coordinate the generation of various outputs in response to those inputs. Some of the inputs include engagement of the audio selection button 38, the illumination selection button 40, the activation button 42, and the volume adjustment switch 44. In addition, the control unit 204 is configured to receive and process user inputs resulting from engagement of the activation button 68 of the remote actuator 64 (see FIG. 1). In response to any of these inputs, the control unit 204 directs the operation of the sound generating mechanism 206, the drive mechanism 104 (see FIG. 3), and/or the light sources 28, 30, 46, 154, 156, 158, and 160 (see FIG. 4). The control unit 204 is coupled to the various components of the mobile 10 by any conventional wired or wireless connections.

In the illustrated embodiment, the control unit 204 includes a memory and a processor (not shown). The memory can be, for example, any conventional memory, such as a disk drive, cartridge, or solid state memory, in which audio content, such as music selections, sound effects, and speech, can be stored. The processor can be, for example, any conventional processor, such as a conventional integrated circuit.

The sound generating mechanism 206 is configured to generate audio output corresponding to stored audio content. Audio outputs from the sound generating mechanism 206 can be heard through the openings 62 formed in the front portion 200 of the base 16. The sound generating mechanism 206 can include, for example, any conventional speaker or other suitable audio transducer.

The rear portion 202 of the base 16 includes a threaded mounting post 208 that is externally threaded. The threaded mounting post 208 is configured to couple with a mounting nut 210 that is internally threaded. In the illustrated embodiment, the base 16 includes a battery cover 212. The battery cover 212 is formed with an opening 214 through which the threaded mounting post 208 extends. The battery cover 212 is configured to be releasably coupled to the rear portion 202 and can be detached to provide access to battery compartments 216 and 218, which are disposed in the rear portion 202. As illustrated in FIG. 5, the battery cover 212 includes an extension 220. The extension 220 is configured to engage a horizontal surface of a structure, such as an infant crib, to maintain the mobile 10 in an upright orientation.

The overall operation of the mobile 10 is described with reference to FIGS. 1, 3, 4, and 5. In the illustrated embodiment, the mobile 10 can be coupled to an infant crib to entertain an infant placed in the infant crib. A user can turn on the mobile 10 by pressing the activation button 42 or the activation button 68 of the remote actuator 64. Once turned on, the control unit 204 activates the drive mechanism 104, which causes the reflective member 18 to rotate. In addition, the suspension member 26 along with the toy characters 32, 34, and 36 rotate with the reflective member 18.

Once activated, the mobile 10 can operate in one of several illumination modes. The user can select a particular illumination mode using the illumination selection button 40. Successive depressions of the illumination selection button 40 allow selection of a particular illumination mode.

In a first illumination mode, the control unit 204 activates all light sources 28, 30, 46, 154, 156, 158, and 160. Activation of the light sources 28, 30, 46, and 154 in the first illumination mode creates a changing reflected light pattern below the mobile 10, which reflected light pattern can surround the infant placed in the crib. Activation of the light sources 156, 158, and 160 in the first illumination mode creates the appearance of a glowing star. In a second illumination mode, the control unit 204 simply activates the light sources 28, 30, 46, and 154 to create a changing reflected light pattern. In a third illumination mode, the control unit 204 simply activates the light sources 156, 158, and 160 to create the appearance of a glowing star. In a fourth illumination mode, the light sources 28, 30, 46, 154, 156, 158, and 160 are not activated.

In addition, the user can select a particular audio content to be played, if any, using the audio selection button 38. Successive depressions of the audio selection button 38 result in scrolling through different audio content stored in the control unit 204. The different audio content corresponds to various music selections and sound effects. The user can select the volume at which a particular audio content is played using the volume adjustment switch 44.

In the illustrated embodiment, the mobile 10 operates for a predetermined time period, such as five or six minutes, after which the mobile 10 automatically turns off. In an alternative embodiment, the mobile 10 may enter into a power down mode after operating for the predetermined time period. Once turned off, the user can turn on the mobile 10 by pressing the activation button 42 or the activation button 68 of the remote actuator 64. In the illustrated embodiment, if the user presses the activation button 42 or 68 before the mobile 10 turns off, the mobile 10 operates for another predetermined time period before turning off. While particular, illustrative embodiments of the invention have been described, numerous variations and modifications exist that would not depart from the scope of the invention. For example, although the reflective member 18 as described above is substantially hemispherical, the reflective member can be any shape that would produce the desired reflective effect. For example, the reflective member can be substantially flat. Moreover, the reflective member 18 can be substantially hemispherical, but positioned such that the concave surface faces downwardly.

Although the reflective outer surface 20 as described above includes a mirror-like material, in an alternative embodiment, the reflective outer surface can be any material that has such reflective properties and may be a continuous reflective surface.

Although the reflective member 18 is described above as being rotatable with respect to the housing 12, in an alternative embodiment, the reflective member 18 may be fixedly coupled to the housing 12 or integrally formed as part of the housing 12. In such an embodiment, the illuminating member 22 can be rotatably coupled to the housing 12 such that the desired illuminating effect described above is produced by rotation of the illuminating member 22. Alternatively, the various light sources 28, 30, 46, and 154 disposed within the illuminating member 22 may be rotated while the illuminating member 22 itself maintains a fixed position.

Although the illuminating member 22 as described above is coupled to the housing, in alternative embodiments the illuminating member 22 can be disposed at any position such that it is able to illuminate the reflective member 18. For example, the illuminating member can be coupled to the support member 14 or the base 16.

Although the support member 14 as described above is a unitary construction, the support member may be reconfigurable between a first orientation in which the base 16 is coupleable to a vertical surface as described and, a second orientation in which the base 16 can rest on a horizontal surface. Such a configuration is described in U.S. patent application Ser. No. 09/968,495, entitled "Convertible Projection Device," filed on Oct. 2, 2001, incorporated herein by reference in its entirety.

As described above, the various housing components, buttons, etc. are formed of plastic materials, but any other material suitable for the described use can be utilized.

Although the power supply as described above is disclosed as batteries, in an alternative embodiment, alternative sources of power could be used, including household AC power.

Although the remotely controlled output as described above uses a simple, one-function remote, in alternative embodiments, other remotes with greater functionality are contemplated. For example, it is contemplated that remotes with buttons for remotely selecting output modes or remotes which transmit Radio-Frequency (RF) verses Infra Red (IR) signals can be used.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. A mobile comprising:

a housing;

a reflective member rotatably coupled to said housing;

a drive mechanism disposed in said housing, said drive mechanism being coupled to said reflective member and being configured to rotate said reflective member with respect to said housing;

an illuminating member coupled to said housing and disposed to illuminate said reflective member;

a base configured to be coupled to an infant crib; and a support member, said support member having a first end and a second end, said first end of said support member being coupled to said base, said second end of said support member being coupled to said housing.

2. The mobile of claim 1, said reflective member having a reflective outer surface.

3. The mobile of claim 1, said illuminating member including a light source, said light source being disposed proximate to said reflective member.

4. The mobile of claim 1, said illuminating member being fixedly coupled to said housing.

5. The mobile of claim 1, further comprising:

a coupling element extending through said reflective member, said coupling element having a first end and a second end, said first end of said coupling element being coupled to said housing, said second end of said coupling element being coupled to said illuminating member.

6. The mobile of claim 1, further comprising:

an elongate suspension member coupled to and depending from said reflective member, said drive mechanism being configured to rotate said suspension member with respect to said housing.

7. The mobile of claim 6, further comprising:

a toy character coupled to said suspension member.

8. The mobile of claim 1, further comprising:

a sound generating mechanism disposed in said base.

9. The mobile of claim 1, said reflective member being hemispherical and being mounted below said housing with its convex side facing downwardly, said illuminating member being disposed below said reflective member and including a light source disposed on an upper surface thereof and oriented to direct light towards said reflective member.

10. The mobile of claim 1, further comprising a first light source disposed on an upper surface of the illuminating member and oriented to direct light towards said reflective member, and a second light source disposed in said illuminating member, said illuminating member having a translucent outer wall, said second light source oriented to direct light through said translucent outer wall.

11. A mobile comprising:

a housing;

a reflective member, said reflective member having a reflective surface and being rotatably coupled to said housing;

a suspension member coupled to said reflective member;

a toy character coupled to said suspension member; and a light source disposed proximate to said reflective member, said light source being configured to illuminate said reflective surface of said reflective member.

12. The mobile of claim 11, further comprising:

a drive mechanism coupled to said reflective member, said drive mechanism being configured to impart motion to said toy character via said reflective member and said suspension member.

13. The mobile of claim 12, further comprising:

a remote actuator configured to activate said drive mechanism.

14. The mobile of claim 11, said toy character being a first toy character, said mobile further comprising a second toy character coupled to said suspension member.

15. A mobile comprising:

a base;

an elongate support member extending upwardly from said base and having a lower end coupled to said base and an opposite, upper end;

a drive housing coupled to said upper end of said elongate support member;

a reflective member, said reflective member having a reflective surface and being coupled to said drive housing for rotational motion with respect thereto;

a drive mechanism disposed in said drive housing and coupled to said reflective member to drive said reflective member in rotational motion;

a suspension member coupled to said reflective member and being rotatable therewith;

a toy character coupled to said suspension member; and a light source disposed proximate to said reflective member, said light source being configured to illuminate said reflective surface of said reflective member.

16. The mobile of claim 15, said base being configured to couple said mobile to an infant crib.

17. The mobile of claim 15, said reflective member being hemispherical and being mounted below said housing with its convex side facing downwardly, said light source being disposed below said reflective member.

18. The mobile of claim 15, said light source being a first light source, said mobile further comprising an illuminating member, said illuminating member having a translucent outer wall and including a second light source disposed within said illuminating member and oriented to direct light through said outer wall.

19. A method of entertaining an infant with a mobile, the mobile including a housing, a reflective member having a reflective surface rotatably coupled to the housing, a light source, a base configured to be coupled to an infant crib, and a support member, said support member having a first end and a second end, said first end of said support member being coupled to said base, said second end of said support member being coupled to said housing, the method comprising:

imparting motion to the reflective member using a drive mechanism disposed in the housing, the drive mechanism being coupled to the reflective member and being configured to rotate the reflective member with respect to the housing; and illuminating the reflective member with the light source.

20. The method of claim 19, said imparting motion to the reflective member including substantially maintaining an orientation of the light source as the reflective member is moved with respect to the light source.

21. The method of claim 19, the mobile further including an elongate suspension member coupled to and depending from the reflective member, the method further comprising:

imparting motion to the suspension member via the reflective member.

22. The method of claim 21, said imparting motion to the reflective member occurring substantially simultaneously with said imparting motion to the suspension member.

23. A mobile comprising:

a housing;

a reflective member coupled to said housing;

an illuminating member rotatably coupled to said housing and disposed to illuminate said reflective member; and a drive mechanism coupled to said illuminating member and being configured to rotate said illuminating member with respect to said housing reflective member.

24. The mobile of claim 23, wherein said reflective member has a reflective outer surface.

25. The mobile of claim 23, wherein said illuminating member includes a light source, said light source being disposed opposite said reflective member.

26. The mobile of claim 23, wherein said reflective member is fixedly coupled to said housing.

27. The mobile of claim 23, further comprising:

a coupling element extending through said reflective member, said coupling element having a first end and a second end, said first end of said coupling element being coupled to said housing, said second end of said coupling element being coupled to said illuminating member.

28. The mobile of claim 23, further comprising:

an elongate suspension member coupled to and depending from said reflective member, said drive mechanism being configured to rotate said suspension member with respect to said housing.

29. A mobile comprising:

a housing;

a reflective member rotatably coupled to said housing;

a drive mechanism disposed in said housing, said drive mechanism being coupled to said reflective member and being configured to rotate said reflective member with respect to said housing;

an illuminating member coupled to said housing and disposed to illuminate said reflective member; and a coupling element extending through said reflective member, said coupling element having a first end and a second end, said first end of said coupling element being coupled to said housing, said second end of said coupling element being coupled to said illuminating member.

30. A mobile comprising:

a housing;

a reflective member rotatably coupled to said housing;

a drive mechanism disposed in said housing, said drive mechanism being coupled to said reflective member and being configured to rotate said reflective member with respect to said housing;

an illuminating member coupled to said housing and disposed to illuminate said reflective member; and an elongate suspension member coupled to and depending from said reflective member, said elongate suspension member having a non-linear configuration, said drive mechanism being configured to rotate said suspension member with respect to said housing.

31. A mobile comprising:

a housing;

a hemispherical member rotatably coupled to said housing, the hemispherical reflective member being positioned below said housing with its convex side facing downwardly;

a drive mechanism disposed in said housing, said drive mechanism being coupled to said reflective member and being configured to rotate said reflective member with respect to said housing; and an illuminating member coupled to said housing and disposed below said reflective member and including a light source disposed on an upper surface thereof and oriented to direct light towards said reflective member to illuminate said reflective member.

* * * * *